US007641767B2

(12) United States Patent
Binder et al.

(10) Patent No.: US 7,641,767 B2
(45) Date of Patent: Jan. 5, 2010

(54) APPARATUS FOR TREATING A FIBROUS SUSPENSION

(75) Inventors: Erwin Binder, Heidenheim (DE); Axel Gommel, Ravensburg (DE); Anton Selbherr, Radolfzell (DE)

(73) Assignee: Voith Patent GmbH, Heidenheim (DE)

( * ) Notice: Subject to any disclaimer, the term of this patent is extended or adjusted under 35 U.S.C. 154(b) by 508 days.

(21) Appl. No.: 11/461,314

(22) Filed: Jul. 31, 2006

(65) Prior Publication Data

US 2007/0029231 A1 Feb. 8, 2007

(30) Foreign Application Priority Data

Aug. 4, 2005 (DE) ..... 10 2005 036 671

(51) Int. Cl.
*D21C 7/06* (2006.01)

(52) U.S. Cl. ..... 162/246; 162/57; 162/56; 162/243; 162/251; 210/413; 210/415; 209/350; 209/273; 209/284

(58) Field of Classification Search ..... 162/246, 162/243, 251, 261, 343, 57, 56, 55; 210/413, 210/415; 209/250, 273, 284, 305, 306
See application file for complete search history.

(56) References Cited

U.S. PATENT DOCUMENTS 5,096,127 A * 3/1992 Young ..... 241/46.17
6,571,957 B1 * 6/2003 Doelle et al. ..... 209/273

* cited by examiner

*Primary Examiner*—Mark Halpern
(74) *Attorney, Agent, or Firm*—Greenblum & Bernstein P.L.C.

(57) ABSTRACT

An apparatus and method serves, e.g., to deaerate, clean or screen a fibrous suspension and is provided with a closed housing and a rotor arranged centrally therein. The rotor puts at least a part of the fibrous suspension guided into the housing into a rotational flow. The fibrous suspension flowing into the housing through the inlet is put into rotation by a guide element acting hydraulically. This increase the efficiency of the apparatus and prevents disturbing turbulences in the apparatus.

24 Claims, 2 Drawing Sheets

APPARATUS FOR TREATING A FIBROUS SUSPENSION

CROSS-REFERENCE TO RELATED APPLICATIONS

The present application claims priority under 35 U.S.C. §119 of German Patent Application No. 10 2005 036 671.6, filed on Aug. 4, 2005, the disclosure of which is expressly incorporated by reference herein in its entirety.

BACKGROUND OF THE INVENTION

1. Field of the Invention

The invention relates to an apparatus and method for treating a fibrous suspension and, more particularly, to a deaeration apparatus, cleaning apparatus or pressurized screen for treating a fibrous suspension.

2. Discussion of Background Information

As is known, fibrous paper stock required for paper production is treated on a paper machine in a stock preparation. With a majority of the process steps carried out in this part of the installation of a paper mill, the fibers are treated and processed in suspension, in particular an aqueous suspension, with a fiber content between 0.5 and 8%. The major part of these process steps is carried out in closed apparatuses, i.e., those that are part of a closed system.

Apparatuses which can be used for the stock preparation can, e.g., be pressurized screens. In these types of apparatus, the fibrous suspension to be treated is pumped through a wet wire, e.g., a screen cylinder (also referred to as a screen basket), by an applied pressure difference. In this way, a part of the fibrous suspension is rejected at the openings of the screen and removed from the housing through a separate opening. A rotor is moved past the screen to prevent the screen from becoming clogged by fibers or rejected contaminants.

Apparatuses can also be designed to deaerate or degas the fibrous suspension. To accomplish such deaerating or degassing, the suspension is put into rapid rotation by the rotor, which causes gases, e.g., air, to accumulate in the center as a result of centrifugal forces. The gases are then removed through a suitable opening. Apparatuses of this type are suitable for replacing complex vacuum-operated degassing containers. They can be arranged directly before a pressure-increasing stock pump which conveys the suspension to the next treatment step. Naturally, the operating energy input used to drive the rotor is a cost factor in the operation of such an apparatus.

SUMMARY OF THE INVENTION

The invention improves apparatuses of the above-mentioned type in that the energy demand required for driving the apparatus or components thereof is reduced without causing disadvantageous consequences for the desired effect of the apparatus.

The invention is related to an apparatus for treating a fibrous suspension. The apparatus includes a closed housing which has at least one infeed for the fibrous suspension to be guided into the housing and at least one outlet for the fibrous suspension to be guided out of the housing. At least one centrally arranged rotor is configured to place at least a part of the fibrous suspension guided into the housing into a rotational flow. At least one guide element acts hydraulically within the housing and is configured to place into rotation the fibrous suspension flowing into the housing through the infeed. The rotational direction of the rotation corresponds to a rotational direction of the rotational flow generated by the rotor.

The above measures contribute substantially to the hydraulic optimization of apparatuses intended for fibrous material treatment. This does not refer to pumps or turbines which, as is known, have long been designed according to purely hydraulic considerations, i.e., with which the optimization of energy efficiency is a tradition.

With the invention, the pressure energy originating from the upstream pump is transformed into kinetic energy in a low-loss manner. Disturbing and energy-dissipating turbulences are largely avoided or at least reduced.

In an aspect of the invention, an apparatus for treating a fibrous suspension comprises a housing having at least one inlet and at least one outlet. At least one rotor is arranged within the housing which places at least a part of the fibrous suspension guided into the housing into a rotational flow. At least one guide element acts hydraulically within the housing and is configured to place into rotation the fibrous suspension. The rotational direction of the rotation corresponds to a direction of the rotational flow generated by the rotor.

In embodiments, the housing has a rotational symmetry. The rotational symmetry is a cylindrical part. The cylindrical part has a perpendicular center line. The cylindrical part has a horizontal center line.

In embodiments, the apparatus further includes a reject discharge. The apparatus can be a pressurized screen comprising a screen, and the screen is kept clear of obstructions by the rotor. The reject discharge carries away fibrous suspension rejected at the screen. The screen is a cylindrical screen installed within the housing.

In embodiments, a central degassing pipe with which gases accumulate centrally as a result of the centrifugal forces generated by the rotational flow are guided out of the apparatus. The gases are air.

In further embodiments, the apparatus may be a degassing device for a paper fiber suspension. The degassing device comprises a fixed housing. The rotor is a drum-shaped rotor which is enclosed within the housing. The fibrous suspension is placed into rotation in an interior space of the drum-shaped rotor.

In embodiments, a central discharge pipe through which materials accumulate centrally as a result of the centrifugal forces generated by the rotational flow are guided out of the apparatus.

In embodiments, the guide element has a plurality of guide blades. The guide element is annular and arranged concentrically with the rotor. The guide blades are curved. The guide blades have essentially flat guide surfaces. The guide blades are at least three guide blades. The guide blades are at least six guide blades. The guide element is closed off by a top wall and a bottom wall lying opposite thereto, and the guide blades are located between the top wall and the bottom wall. The top wall and the bottom wall are flat and parallel with respect to one another. The top wall or the bottom wall has a domed internal profile which causes a distance to the top wall from the bottom wall to become smaller, radially outward.

In embodiments, channels are formed between the guide blades. The channels have a flow cross section of which becomes smaller in the flow direction.

In embodiments, the inlet is connected tangentially to the housing. The inlet is connected to a spiral inlet channel, located radially outside of the guide element. The inlet is connected centrally to the housing. The rotor is centrally arranged within the housing.

In another aspect of the invention, a process for treating fibrous suspension comprises guiding fibrous suspension S radially outward to place it into a rotation direction and rotating the fibrous suspension in a rotational flow. The rotational direction corresponds to a direction of the rotational flow.

In further embodiments, the guiding is provided by a guide element and the rotating is provided by a rotor. The guide element is positioned in a flow direction of the fibrous suspension prior to the rotor. The guiding is a hydraulic action provided prior to the rotating.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
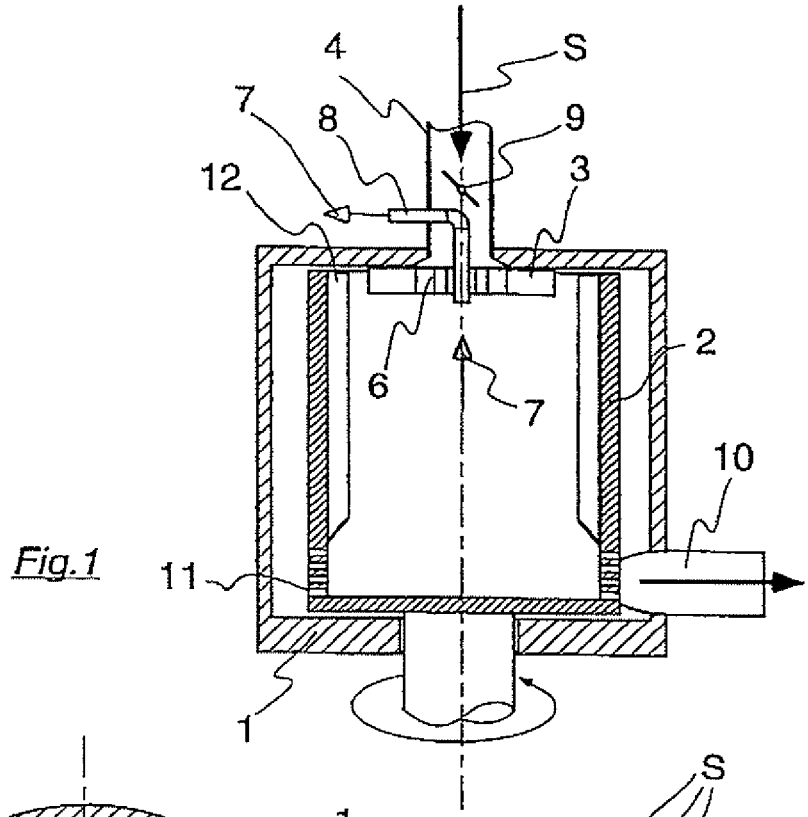
FIG. 1 shows an exemplary deaeration apparatus according to the invention.

FIG. 1 shows an exemplary deaeration apparatus according to the invention. This representation sufficiently illustrates the function of an apparatus of this type. A drum-shaped rotor 2 is arranged in a fixed housing 1. The interior space of the rotor 2 is supplied with a liquid to be degassed such as, for example, a paper fiber suspension S. The rotor 2 places the fibrous suspension S into a rotational flow. In embodiments, the housing 1 has a rotational symmetry, e.g., a cylindrical part. The rotor 2 is arranged concentrically within the cylindrical part.

The added liquid, for example, the fibrous suspension S, empties into the housing from an inlet 4. The added liquid, which flows radially outward, runs through a guide element 3, which acts hydraulically on the liquid. The guide element 3 is, in embodiments, constructed in an annular manner and arranged concentrically with the rotor 2. The guide element 3 has several blades 6 and is closed at the bottom so that channels 5 (FIG. 2) form between the blades 6. The channels 5 guide the fiber suspension S radially outward and thereby place it into rotation. In embodiments, the rotational direction of the fiber suspension S equals or substantially equals that of the rotational flow generated by the rotor 2. The effect of the rotor 2 can be intensified by the blades 6, or driver strips 12 rotating with the rotor 2.

As a result of the centrifugal forces, the liquid lies against the inside wall of the rotor 2, whereby the gas 7, e.g., air, contained therein shifts radially inward. As a rule, an interface forms between the liquid and the gas 7. The gas 7 can be discharged or suctioned off through a central degassing pipe 8. With a continuous operation of this degassing device, the operating conditions can be regulated, e.g., by an input throttle 9, such that a steady liquid flow forms from the inlet 4 to an outlet 10.

With the drum-shaped rotor 2, the wall of the housing may be liquid-permeable in the area of the outlet 10, e.g., by adding openings 11 to the rotor 2. The outlet 10 is attached in a tangential manner to the housing 1 such that the rotational flow of the liquid degassed at this location causes a rise in pressure in the outlet 10. The openings 11 in the wall of the rotor 2 are sized such that they do not lead to a screening of the degassed liquid, and thus cannot form a solids reject.

The apparatus shown in FIG. 1 can also be used to remove lightweight contaminants from a fibrous suspension S. As is known, a proportion of such contaminants, e.g., plastic foam particles ("styrofoam"), can be contained with the preparation of recovered paper, which proportion accumulates centrally as a result of the centrifugal forces. The contaminants can be discharged by a lightweight-material discharge pipe, which is the same as or similar to the degassing pipe 8 of FIG. 1.

Figure 2:
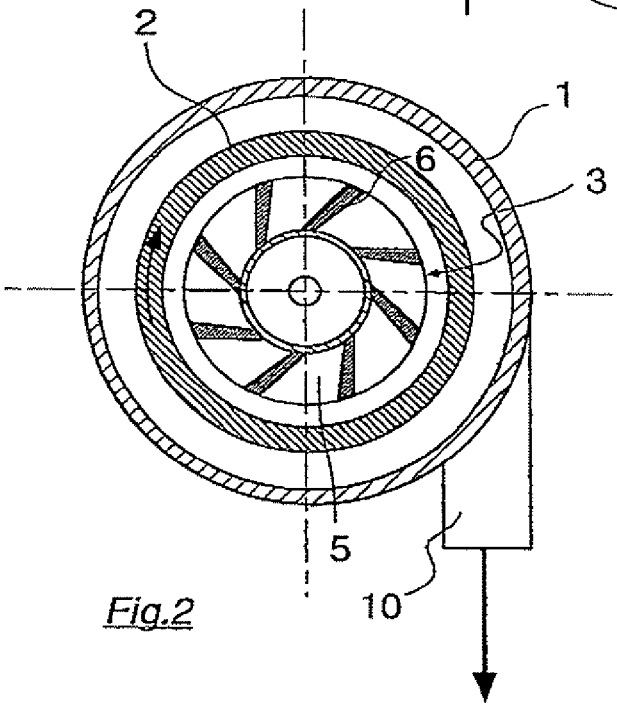
FIG. 2 shows a top view of a similar apparatus as shown in FIG. 1.

FIG. 2 shows a top view of the upper part of a deaeration apparatus according to the invention. According to this representation, the guide element 3 contains a total of eight guide blades 6 which have essentially flat guide surfaces, it should be understood by those of skill in the art that the guide element 3 may contain other amounts of guide blades 6. In order to be able to serve the desired purpose, i.e., to put the influent fibrous suspension S into rotation, the guide blades 6 are positioned obliquely with respect to the radius. The channels 5 are located between the guide blades 6, which guides the influent suspension S radially outward to place the effluent into rotation.

Figure 3:
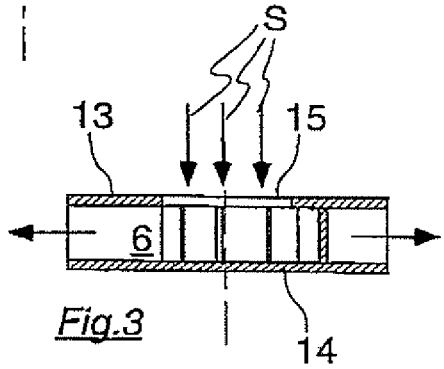
FIG. 3 shows an embodiment of guide elements according to the invention.

As shown in FIG. 3, the guide element 3 is closed off by a top wall 13 and a bottom wall 14 lying opposite to the top wall 13. The guide blades 6 are located between the top wall 13 and the bottom wall 14. It is possible to embody the top wall 13 and the bottom wall 14 as flat, parallel, coaxial disks, where the top wall 13 is provided with a central inlet opening 15 for the influent suspension.

Figure 4:
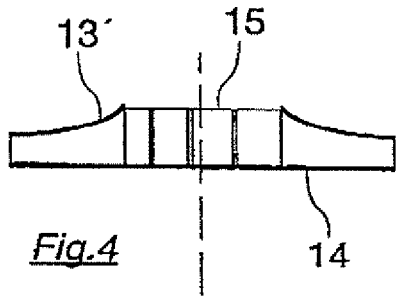
FIG. 4 shows an embodiment of guide elements according to the invention.

As is shown in FIG. 4, the top wall 13' (or in other cases the bottom wall 14) is provided with a domed internal profile. This causes the distance to the opposite wall and thus also the height of the flow channels 5 to become smaller towards the outside. This configuration has the advantage that during operation the flow speed does not decrease too much and, in embodiments, increases radially from the inside outward.

Figure 5:
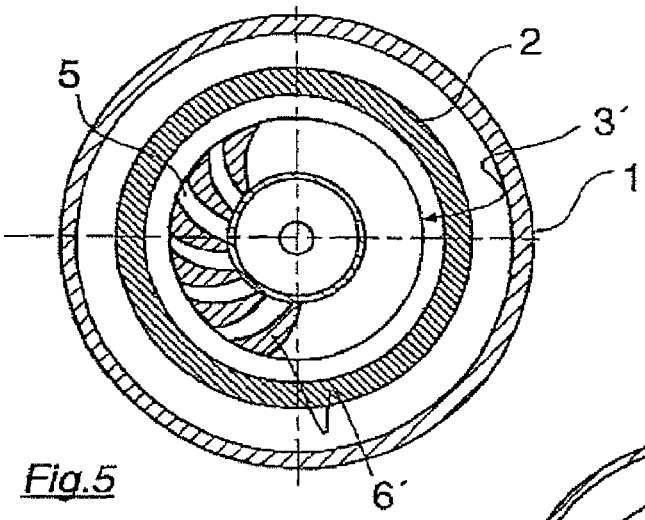
FIG. 5 shows a deaeration apparatus according to the invention with a varied guide element.

As shown in FIG. 5 the guide blades 6' of the guide element 3' may be curved in order to avoid undesired turbulences. FIG. 5 further shows that a thickness of the guide blades 6' of the guide element 3' increases towards the outside, with the advantage of a reduction in the flow cross section.

Figure 6:
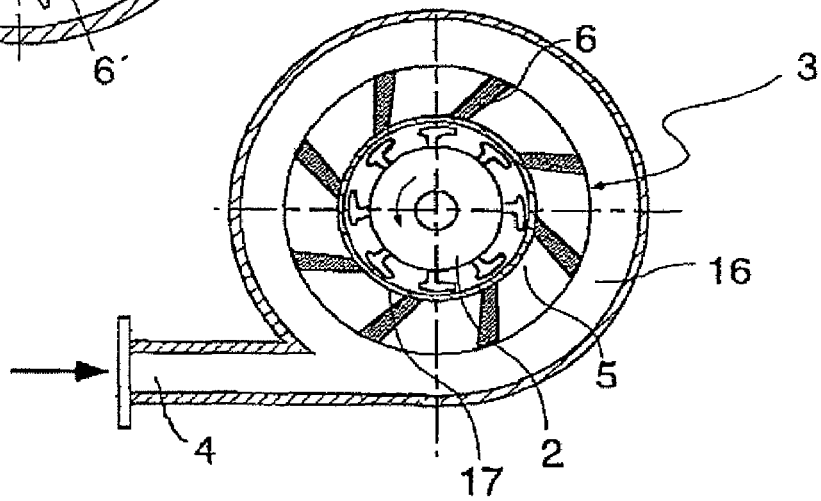
FIG. 6 shows a top view of a pressurized screen apparatus according to the invention.
Figure 7:
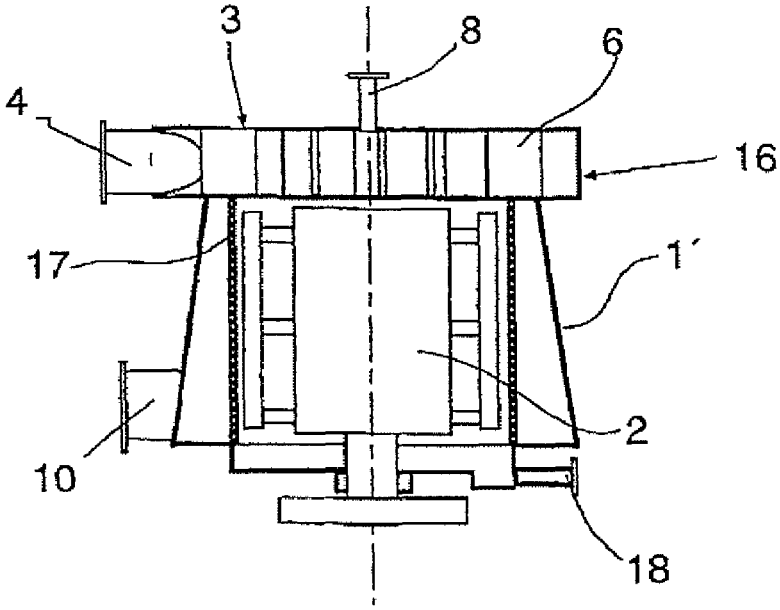
FIG. 7 shows a side view of a pressurized screen apparatus similar to that shown in FIG. 6.

FIGS. 6 and 7 show a pressurized screen in accordance with the invention. In these figures, a screen 17, e.g., a screen basket, is shown, which retains, e.g., contaminants, from the suspension. The contaminants can be removed from the housing 1' through a reject discharge 18. A particularly low-loss conversion of hydraulic pressure energy into kinetic energy can also be carried out with an apparatus of the type shown in FIGS. 6 and 7 by using a suitable guide element 3. In this respect it should be noted that with pressurized screens a relative speed between the rotor and suspension is generally desired in order to maintain the clearing effect of the rotor. But the invention can still offer advantages, and in particular if an increased air and/or lightweight-part separation is to be achieved. Disturbing turbulences during the acceleration of the suspension by the rotor can be avoided.

It should now be understood by those of skill in the art, in cases where the infeed into the housing 1' of the pressurized screen 7 is arranged centrally it is possible to proceed in a similar manner, as has already been shown according to examples of the deaeration apparatus (FIGS. 1 through 5).

With other pressurized screens, however, the infeed of the suspension to be screened is not central, but is tangential or radial (see, e.g., FIGS. 6 and 7). In such cases, the guide element 3 can be used in interaction with an annular channel 16 lying outside the housing 1'. The annular channel 16 can be essentially rotationally symmetrical to the center of the screen 17 or as a spiral casing, as is known, e.g., with the delivery-side outlet of rotary pumps.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for treating a fibrous suspension, comprising:

a housing having at least one inlet and at least one outlet;

at least one rotor arranged within the housing which places at least a part of the fibrous suspension guided into the housing into a rotational flow; and at least one guide element acting hydraulically within the housing and configured to place into rotation the fibrous suspension, the at least one guide element including a plurality of guide blades, wherein a rotational direction of the rotation corresponds to a direction of the rotational flow generated by the rotor, and the guide element is closed off by a top wall and a bottom wall lying opposite thereto, and the guide blades are located between the top wall and the bottom wall.

2. The apparatus according to claim 1, wherein the housing has a rotational symmetry.

3. The apparatus according to claim 2, wherein the rotational symmetry is a cylindrical part.

4. The apparatus according to claim 3, wherein the cylindrical part has a perpendicular center line.

5. The apparatus according to claim 3, wherein the cylindrical part has a horizontal center line.

6. The apparatus according to claim 1, further comprising a reject discharge, wherein:

the apparatus is a pressurized screen comprising a screen;

the screen is kept clear of obstructions by the rotor; and the reject discharge carries away fibrous suspension rejected at the screen.

7. The apparatus according to claim 6, wherein the screen is a cylindrical screen installed within the housing.

8. The apparatus according to claim 1, further comprising a central degassing pipe with which gases accumulating centrally as a result of the centrifugal forces generated by the rotational flow are guided out of the apparatus.

9. The apparatus according to claim 8, wherein the gases are air.

10. The apparatus according to claim 8, wherein the apparatus is a degassing device for a paper fiber suspension.

11. The apparatus according to claim 10, wherein the degassing device comprises a fixed housing, the rotor is a drum-shaped rotor which is enclosed within the housing, and the fibrous suspension is placed into rotation in an interior space of the drum-shaped rotor.

12. The apparatus according to claim 1, further comprising a central discharge pipe through which materials accumulating centrally as a result of the centrifugal forces generated by the rotational flow are guided out of the apparatus.

13. The apparatus according to claim 1, wherein the guide element is annular and arranged concentrically with the rotor.

14. The apparatus according to claim 1, wherein the guide blades are curved.

15. The apparatus according to claim 14, wherein the guide blades have essentially flat guide surfaces.

16. The apparatus according to claim 1, wherein the guide blades are at least three guide blades.

17. The apparatus according to claim 16, wherein the guide blades are at least six guide blades.

18. The apparatus according to claim 1, wherein the top wall and the bottom wall are flat and parallel with respect to one another.

19. The apparatus according to claim 1, wherein the top wall or the bottom wall has a domed internal profile which causes a distance to the top wall from the bottom wall to become smaller, radially outward.

20. The apparatus according to claim 1, further comprising channels between the guide blades, the channels having a flow cross section of which becomes smaller in the flow direction.

21. The apparatus according to claim 1, wherein the inlet is connected tangentially to the housing.

22. The apparatus according to claim 1, wherein the inlet is connected to a spiral inlet channel, located radially outside of the guide element.

23. The apparatus according to claim 1, wherein the inlet is connected centrally to the housing.

24. The apparatus according to claim 1, wherein the rotor is centrally arranged within the housing.

* * * * *